US010954754B2

(12) United States Patent
Stokes et al.

(10) Patent No.: US 10,954,754 B2
(45) Date of Patent: Mar. 23, 2021

(54) METHODS AND ASSEMBLIES FOR RUNNING AND TESTING TOOLS

(71) Applicant: Halliburton Energy Services, Inc., Houston, TX (US)

(72) Inventors: Matthew Bradley Stokes, Keller, TX (US); Christian Alexander Ramirez, Arlington, TX (US); Lester Barett Dupler, Gunter, TX (US); Borisa Lajesic, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 327 days.

(21) Appl. No.: 16/084,764

(22) PCT Filed: Nov. 14, 2017

(86) PCT No.: PCT/US2017/061579
§ 371 (c)(1),
(2) Date: Sep. 13, 2018

(87) PCT Pub. No.: WO2019/098996
PCT Pub. Date: May 23, 2019

(65) Prior Publication Data

US 2020/0300062 A1 Sep. 24, 2020

(51) Int. Cl.
*E21B 41/00* (2006.01)
*E21B 33/10* (2006.01)
(Continued)

(52) U.S. Cl.
CPC ..... *E21B 41/0042* (2013.01); *E21B 47/06* (2013.01); *E21B 17/02* (2013.01);
(Continued)

(58) Field of Classification Search
CPC .. E21B 41/0042; E21B 47/06; E21B 2200/01; E21B 17/02; E21B 33/12;
(Continued)

(56) References Cited

U.S. PATENT DOCUMENTS 4,986,362 A 1/1991 Pleasants
5,794,694 A 8/1998 Smith, Jr.
(Continued)

FOREIGN PATENT DOCUMENTS

GB 2411189 8/2005
WO 2014089132 6/2014

OTHER PUBLICATIONS

Flatern , "Well Testing Fundamentals", 2013, pp. 54-55.
(Continued)

*Primary Examiner* — Brad Harcourt
(74) *Attorney, Agent, or Firm* — Kilpatricj Townsend & Stockton LLP

(57) ABSTRACT

Assemblies and methods are provided for positioning a sealing tool within a receptacle and pressure testing a seal between the sealing tool and the receptacle. The assembly may be coupled to the sealing tool for latching the sealing tool into the receptacle. The assembly may include a projection that is movable between a coupled position and an uncoupled position. In the coupled position, the projection may couple the assembly to the sealing tool. In the uncoupled position, the projection may be positioned such that the assembly is not coupled to the sealing tool. The projection may move from the coupled position to the uncoupled position in response to determining a seal is established between the sealing tool and the receptacle.

20 Claims, 9 Drawing Sheets

(51) Int. Cl.

| | |
|---|---|
| ***E21B 47/06*** | (2012.01) |
| *E21B 17/02* | (2006.01) |
| *E21B 33/12* | (2006.01) |
| *E21B 43/10* | (2006.01) |

(52) U.S. Cl.
CPC ..... *E21B 33/12* (2013.01); *E21B 43/10* (2013.01); *E21B 2200/01* (2020.05)

(58) Field of Classification Search
CPC ..... E21B 43/10; E21B 47/117; E21B 23/04; E21B 41/00
See application file for complete search history.

(56) References Cited

U.S. PATENT DOCUMENTS

| | | | | |
|---|---|---|---|---|
| 6,209,644 | B1 * | 4/2001 | Brunet | E21B 41/0042 166/117.6 |
| 7,028,777 | B2 | 4/2006 | Wade et al. | |
| 7,490,669 | B2 | 2/2009 | Walker et al. | |
| 8,408,309 | B2 | 4/2013 | Eppinghaus et al. | |
| 2013/0264071 | A1 | 10/2013 | Noffke et al. | |
| 2016/0362974 | A1 | 12/2016 | Sanchez et al. | |
| 2017/0226817 | A1 | 8/2017 | Richards et al. | |
| 2019/0106940 | A1 * | 4/2019 | Korf | E21B 7/061 |

OTHER PUBLICATIONS

International Patent Application No. PCT/US2017/061579, International Search Report and Written Opinion dated Sep. 10, 2018, 20 pages.

* cited by examiner

METHODS AND ASSEMBLIES FOR RUNNING AND TESTING TOOLS

TECHNICAL FIELD

The present disclosure relates generally to assemblies and methods for the completion of wellbores of a subterranean wellbore, and more particularly (although not necessarily exclusively), to assemblies and methods for running a tool downhole and pressure testing a seal between the tool and a receptacle in the wellbore.

BACKGROUND

A well can be a multilateral well. A multilateral well can have multiple lateral wellbores that branch off a main wellbore. The wellbore can be drilled vertically, directionally, or at an inclined angle, and the lateral wellbores can be drilled horizontally, or otherwise deviated, off the main wellbore. Multilateral wellbores can have an increased productive capacity and higher recoverable reserves. A sealing tool may be positioned within a main wellbore, for example a deflector tool, a plug tool, or a packer tool. The sealing tool may be latched into a receptacle within the main wellbore. The sealing tool may be sealed to the receptacle. For example, a completion deflector assembly may be latched into and sealed to a polished bore receptacle.

DETAILED DESCRIPTION

Figure 1:
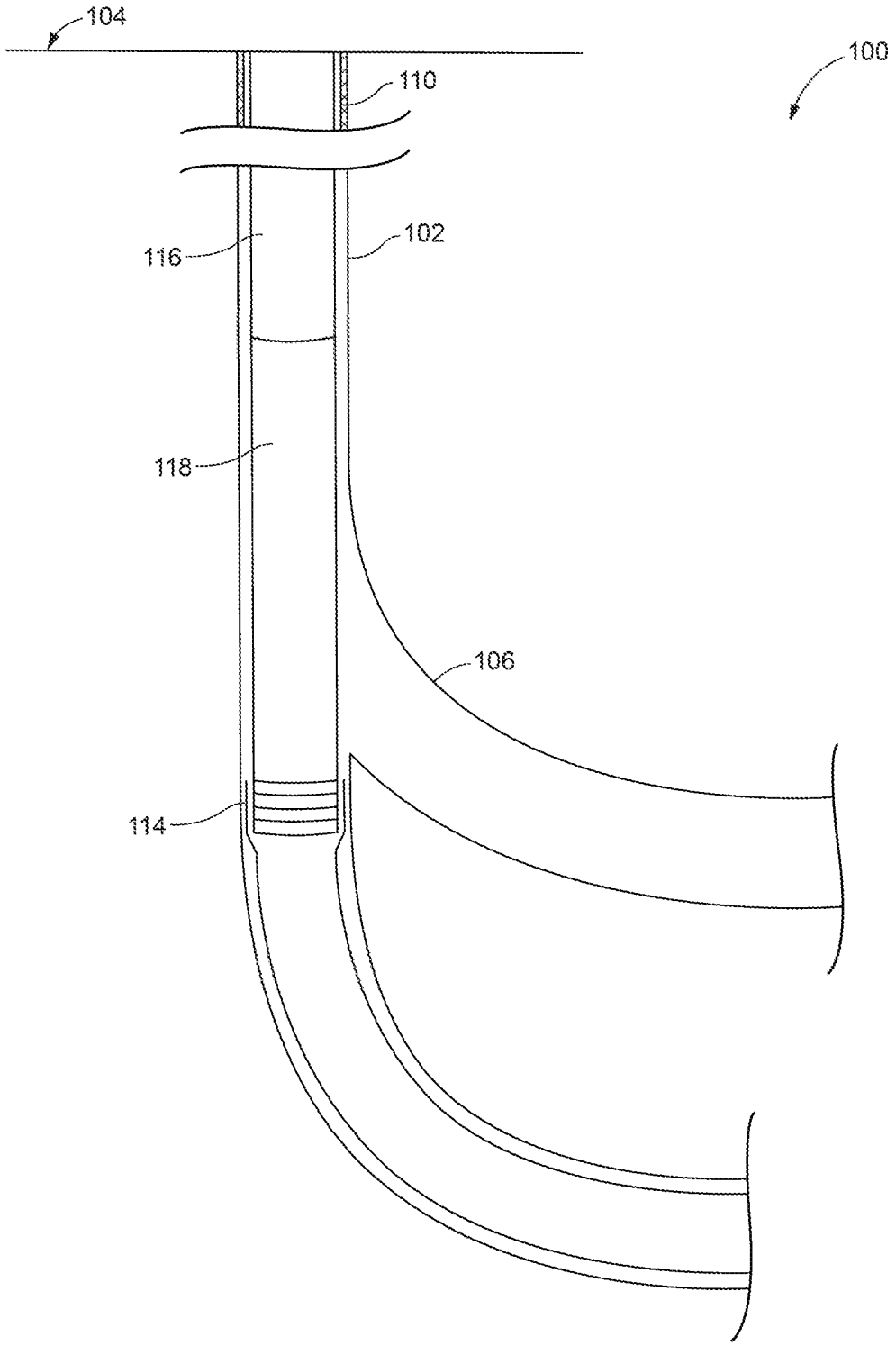
FIG. 1 is a schematic illustration of a multilateral well system with a tool assembly coupled to a downhole tool, according to one aspect.

Certain aspects and features of the present disclosure relate to a tool assembly and methods for latching a downhole tool into a receptacle downhole and pressure testing a seal between the downhole tool and the receptacle in a multilateral well system using the tool assembly. In some aspects, the tool assembly and the downhole tool may be coupled and run-in-hole together into a main wellbore. The downhole tool may be latched into a receptacle within the main wellbore, such as a polished bore receptacle, open hole stinger, or other suitable sealing component. The tool assembly may test a seal between the downhole tool and the receptacle. The tool assembly may be uncoupled from the downhole tool in response to determining a seal has been established between the downhole tool and the receptacle.

In some aspects, the tool assembly and the downhole tool may remain coupled in response to determining a seal has not been established between the downhole tool and the receptacle. In such aspects, the tool assembly and the downhole tool may be returned to the surface together, for example to determine why the seal was not established between the downhole tool and the receptacle.

In some aspects, the seal between the downhole tool and the receptacle may be tested by applying a pressure from the surface and monitoring if the applied pressure (e.g., the test pressure) is maintained over a period of time. It may be determined that a seal is established between the downhole tool and the receptacle when the test pressure is maintained over the period of time. In response to determining a seal is established between the downhole tool and the receptacle, additional pressure may be applied from the surface. The additional pressure may cause the tool assembly to uncouple from the downhole tool, permitting the return of the tool assembly to the surface while the downhole tool remains coupled and sealed to the receptacle downhole. In some aspects, the tool assembly and the downhole tool may be uncoupled by applying a compressive force from the surface.

In some aspects, the downhole tool may include, but is not limited to a sealing tool, for example a deflector tool (e.g., a completion deflector assembly) that seals into a receptacle, a packer, a plug, a bridge plug, or any other suitable tool. A deflector tool may be positioned in a main wellbore for deflecting tools into a lateral wellbore. As described further below, the downhole tool may be both run-in-hole and pressure tested by the same tool assembly, making deployment of the downhole tool more efficient.

These illustrative aspects and examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 depicts by schematic illustration an example of a well system that includes a bore that is a main wellbore 102 extending through a surface 104 and various earth strata. The main wellbore 102 is a wellbore from which at least one lateral wellbore extends. A "main wellbore" may itself also be a lateral wellbore. A lateral wellbore 106 extends substantially horizontally from the main wellbore 102.

The main wellbore 102 may include a casing string 110 cemented at an upper portion of the main wellbore 102. A receptacle 114, which may be a polished bore receptacle, open hole stinger, or other suitable sealing component, may be positioned in the main wellbore 102 below the junction between the main wellbore 102 and the lateral wellbore 106. The receptacle 114 may be sized and shaped to receive a downhole tool 118, for example a completion deflector assembly. The downhole tool 118 may be coupled to a tool assembly 116 for transporting the downhole tool 118 downhole and latching the downhole tool 118 into the receptacle 114. The downhole tool 118 may include a surface for sealing the downhole tool 118 to the receptacle 114. Though shown in the main wellbore 102, the receptacle 114 can be positioned in other locations within the main wellbore 102, including within the casing string 110 of the main wellbore 102, within the intermediate casing string, within a separate completion string positioned within the main wellbore 102, or other suitable locations. In some aspects, the receptacle may be positioned in a lateral wellbore.

The tool assembly 116 may also test a seal between the downhole tool 118 and the receptacle 114. In some aspects, a test pressure may be applied from the surface 104 to determine if a seal is established between the downhole tool 118 and the receptacle 114. The test pressure applied from the surface 104 may be maintained over a period of time when a seal is established between the downhole tool 118 and the receptacle 114. Additional pressure may be applied from the surface 104 in response to the test pressure being maintained over a period of time, indicating a seal being established between the downhole tool 118 and the receptacle 114. The tool assembly 116 may uncouple from the downhole tool 118 in response to the application of the additional pressure from the surface 104. The tool assembly 116 may return to the surface 104 leaving the downhole tool 118 latched into the receptacle 114.

The tool assembly 116 may remain coupled to the downhole tool 118 in response to the test pressure applied from the surface 104 not being maintained over a period of time, indicating a seal was not established between the downhole tool 118 and the receptacle 114. The tool assembly 116 and the downhole tool 118 return together to the surface 104 to determine why a seal was not established between the downhole tool 118 and the receptacle 114.

Figure 2:
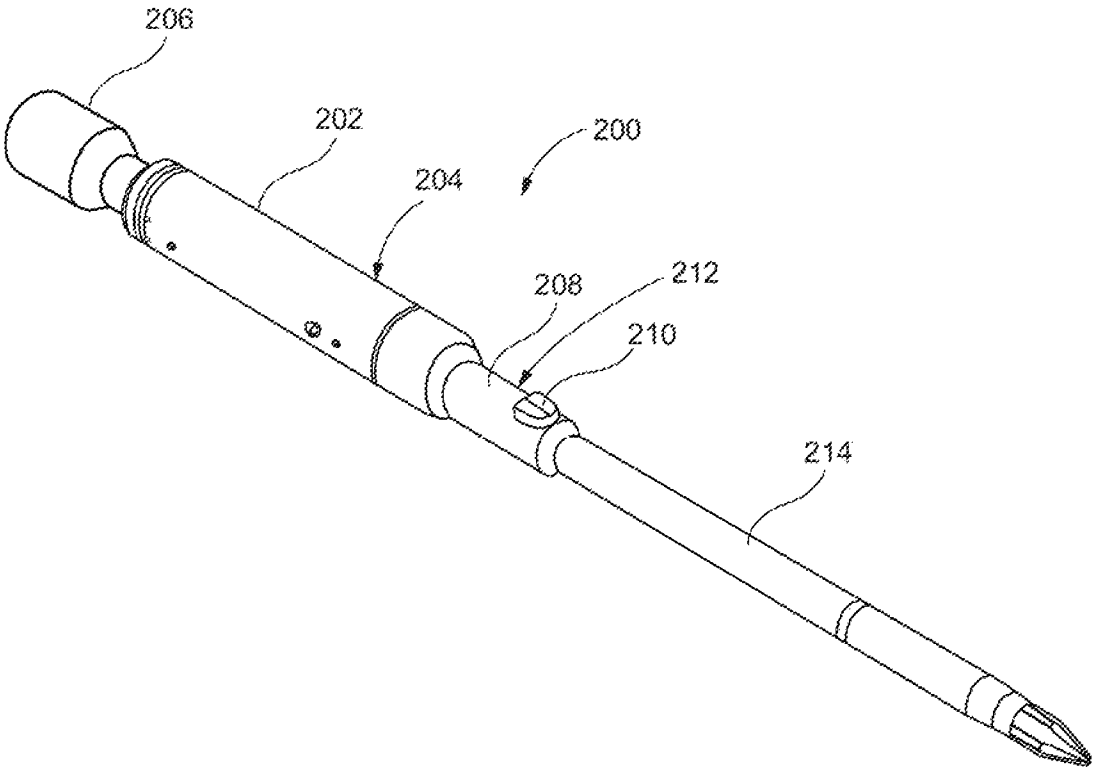
FIG. 2 is perspective view of a tool assembly for running a downhole tool downhole and pressure testing a seal between the downhole tool and a receptacle, according to one aspect.

FIG. 2 depicts a perspective view of a tool assembly 200 for latching a downhole tool into a receptacle and pressure testing a seal between the downhole tool and the receptacle. The tool assembly 200 may include a housing 202. The housing 202 may include an outer surface 204. The tool assembly 200 may include a sub housing, for example a shifting sub housing 206 that may be partially positioned within an inner region of the housing 202. The tool assembly 200 may also include an additional sub housing, for example a torque sub 208, that may be coupled to the housing 202. The torque sub 208 may include a raised surface, for example a projection 210 that extends from an outer surface 212 of the torque sub 208. The projection 210 may be sized and shaped to be received within a recess of a downhole tool, for example but not limited to a deflector tool, for coupling the tool assembly 200 to the downhole tool to prevent relative rotation between the tool assembly 200 and the downhole tool. The tool assembly 200 may also include a sealing element, for example a seal stinger 214, that is sized and shaped to be received within an inner diameter of the downhole tool to seal the tool assembly 200 to the downhole tool.

Figure 3:
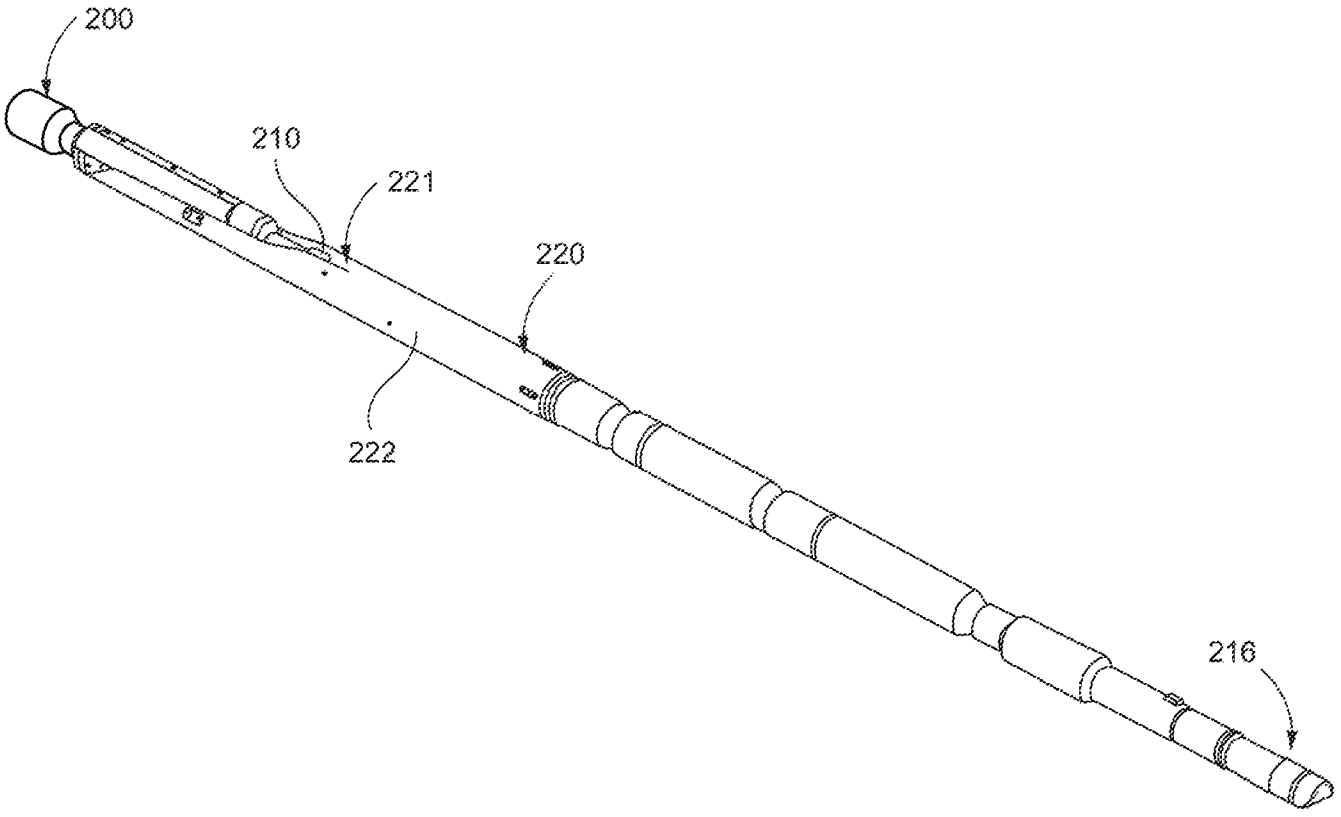
FIG. 3 is a perspective view of a tool assembly coupled to a downhole tool, according to one aspect.
Figure 4:
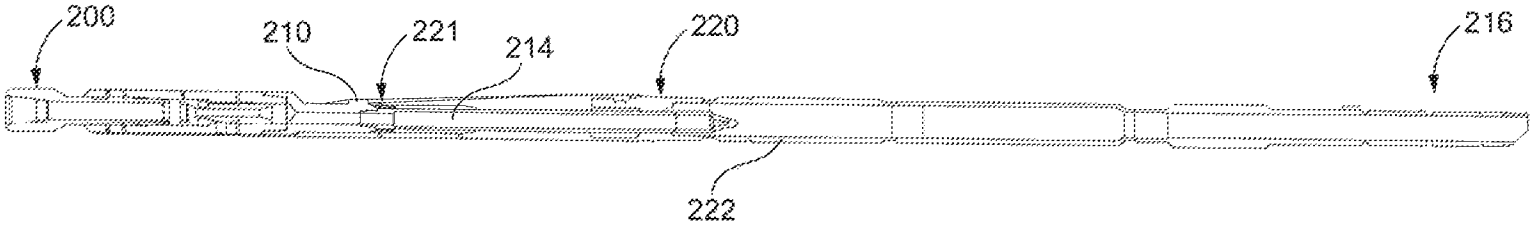
FIG. 4 is a cross-sectional side view of the tool assembly coupled to the downhole tool, according to one aspect.

FIG. 3 depicts a perspective view of a tool assembly, for example tool assembly 200, coupled to a downhole tool, for example but not limited to a completion deflector assembly 220. In some aspects, the downhole tool may be a packer, a bridge plug, another sealing tool, or any other suitable downhole tool. The tool assembly 200 and the completion deflector assembly 220 are shown coupled together in a run-in-hole position shown in FIG. 3. FIG. 4 depicts a cross-sectional side view of the tool assembly 200 coupled to the completion deflector assembly 220 in the run-in-hole position shown in FIG. 3.

As shown in FIG. 4, the seal stinger 214 is sized and shaped to be received in an inner diameter of the completion deflector assembly 220 to seal the tool assembly 200 to the completion deflector assembly. The tool assembly 200 includes the projection 210 which may be sized and shaped to be received within a recess 221 in a housing 222 of the completion deflector assembly 220 for coupling the tool assembly 200 to the completion deflector assembly 220 to prevent relative rotation between the tool assembly 200 and the completion deflector assembly 220. An end 216 of the completion deflector assembly 220 may be positioned downhole and may couple to a receptacle, for example but not limited to polished bore receptacle, open hole stinger, or other suitable sealing component.

Figure 5:
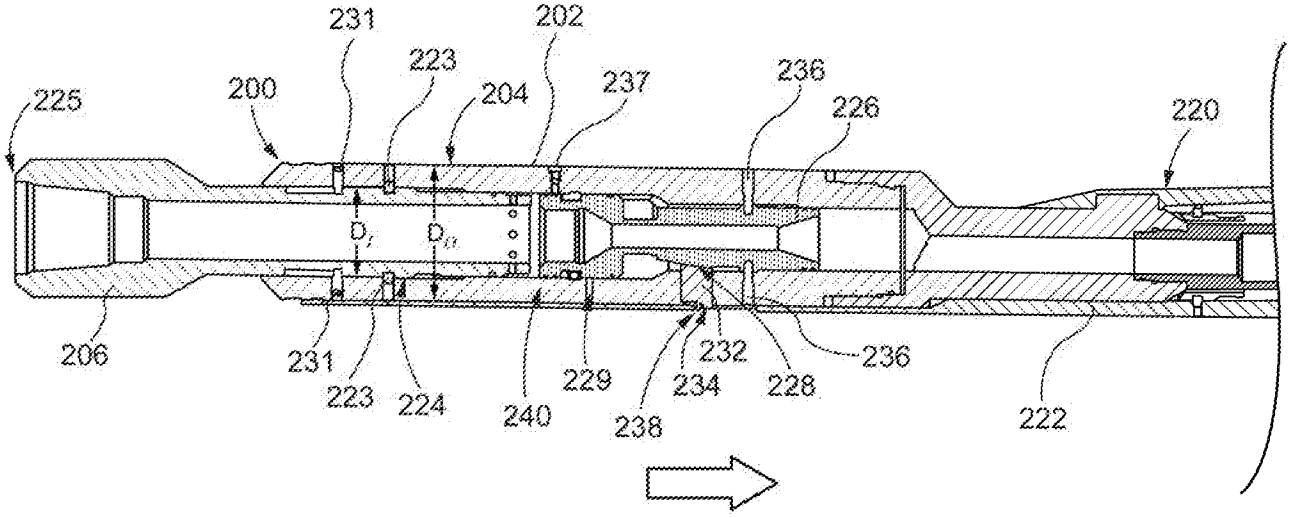
FIG. 5 is a partial cross-sectional view of the tool assembly coupled to the downhole tool, according to one aspect.

FIG. 5 depicts a partial cross-sectional side view of the tool assembly 200 coupled to the completion deflector assembly 220 in the run-in-hole position shown in FIG. 4. The tool assembly 200 and the completion deflector assembly 220 may be run-in-hole while coupled as shown in FIGS. 3-5. The end 216 (shown in FIG. 3) of the completion deflector assembly 220 may couple to the receptacle downhole, while the tool assembly 200 is coupled to the completion deflector assembly 220. The tool assembly 200 may also be used to test if a seal is established between the completion deflector assembly 220 and the receptacle while the tool assembly 200 is coupled to the completion deflector assembly 220.

The tool assembly 200 may be uncoupled from the completion deflector assembly 220 when the test indicates a seal is established between the downhole receptacle and the completion deflector assembly 220. The tool assembly 200, once uncoupled from the completion deflector assembly 220, may return to the surface leaving the completion deflector assembly 220 latched into the receptacle downhole. In some aspects, the tool assembly 200 may be uncoupled from the completion deflector assembly 220 by an application of pressure from the surface. In some aspects, the tool assembly 200 may be uncoupled from the completion deflector assembly 220 by an application of a compressive force from the surface.

In some aspects, the tool assembly 200 may remain coupled to the completion deflector assembly 220 when the test indicates a seal is not established between the downhole receptacle and the completion deflector assembly 220. The tool assembly 200 and the completion deflector assembly 220 may remain coupled and together be returned to the surface to determine why a seal was not established.

As shown in FIG. 5, the outer surface 204 of the housing 202 of the tool assembly 200 may define an outer diameter $D_o$. An inner surface 224 of the housing 202 may define an inner diameter $D_I$. The shifting sub housing 206 may be at least partially positioned within the inner diameter $D_I$ of the housing 202. The shifting sub housing 206 may be coupled to the housing 202 of the tool assembly 200 by one or more pins, for example pins 231. One or more shear pins 223 may also couple the shifting sub housing 206 to the housing 202 and may retain the shifting sub housing 206 in place in the run-in-hole position. The shear pins 223 may shear or break away in response to an application of force on an end 225 of the shifting sub housing 206.

The tool assembly 200 may include a piston 226 positioned within the inner diameter $D_I$ of the housing 202. The piston 226 may be retained in the run-in-hole position shown in FIG. 5 by one or more pins, for example shear pins 236. The shear pins 236 may shear or break in response to a force applied to an end 240 of the piston 226. The piston 226 may include one or more recesses 228 along a length of an outer surface of the piston 226. A projection 232 may be positioned within each recess 228. The projection 232 may move along a length of the recess 228. In some aspects, the piston 226 includes multiple recesses 228, each containing a projection 232 positioned therein, for example in some aspects three projections 232 are positioned in three respective recesses 228 in the outer surface of the piston 226 (e.g., recesses 228 positioned at a left side, a right side, and a bottom side of the tool assembly 200). In some aspects, more or fewer projections 232 and recesses 228 may be used. As shown in FIG. 5, in the run-in-hole position in which the tool assembly 200 is coupled to the completion deflector assembly 220, the projection 232 extends through an opening 234 in the housing 202 of the tool assembly 200. The projection 232 also extends through an opening 238 in housing 222 of the completion deflector assembly 220, coupling the tool assembly 200 to the completion deflector assembly 220.

Figure 6:
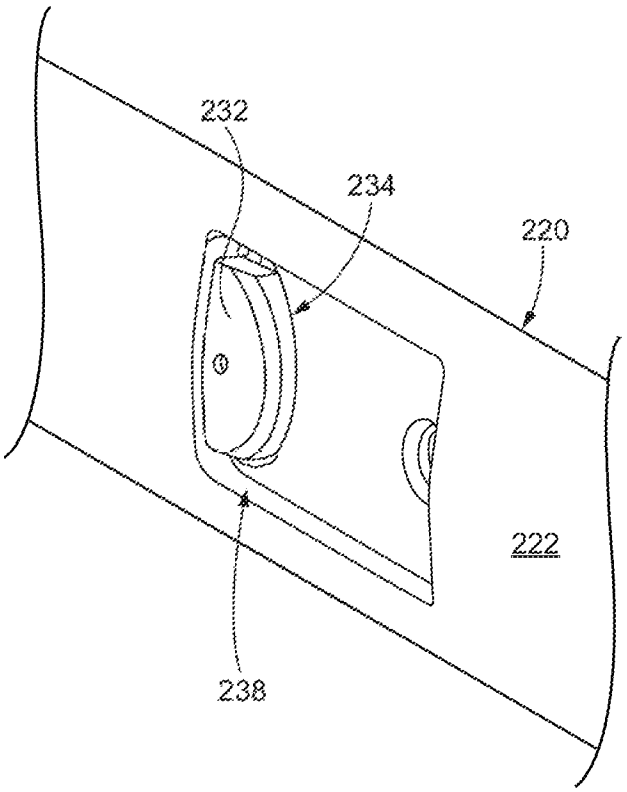
FIG. 6 is an enlarged perspective view of a portion of the tool assembly and the downhole tool in the position shown in FIG. 5, according to one aspect.

FIG. 6 depicts an enlarged perspective view of a portion of the tool assembly 200 (shown in FIG. 5) and completion deflector assembly 220 that includes the projection 232 and openings 234 and 238. As shown in FIGS. 5 and 6, the projection 232 couples the tool assembly 200 to the completion deflector assembly 220 by extending into the opening 238 in the housing 222 of the completion deflector assembly 220. The projection 232 may also be moveable in response to the piston 226 moving in a first direction (shown by an arrow in FIG. 5) between the run-in-hole position (shown in FIG. 5) and an actuated position (shown in FIG. 7). For example, the projection 232 may be moveable in an inward direction away from the housing 222 to uncouple from the downhole completion assembly 220 by withdrawing from the opening 238 in the housing 222.

As described above, the tool assembly 200 and the completion deflector assembly 220 may be run-in-hole coupled together in the position shown in FIGS. 3-6. An end of the completion deflector assembly 220 may latch into a downhole receptacle. The tool assembly 200 may remain coupled to the completion deflector assembly 220 to test if a seal is established between the completion deflector assembly 220 and the downhole receptacle. In some aspects, a first pressure (e.g., a test pressure) may be applied from the surface of the wellbore to test for a seal between the completion deflector assembly 220 and the downhole receptacle. A seal between the completion deflector assembly 220 and the downhole receptacle may be determined to be established when the test pressure is maintained for a desired amount of time.

In response to the test pressure being maintained for the desired amount of time, additional pressure may be applied from the surface; the additional pressure may be greater than the test pressure. The additional pressure may cause the tool assembly 200 to uncouple from the completion deflector assembly 220. In some aspects, an additional pressure applied from the surface may force the piston 226 in a first direction (shown by the arrow in FIG. 5). The shear pins 236 that retain the piston 226 in place in the run-in-hole position may shear or break in response to the piston 226 being forced in the first direction by the additional pressure from the surface, thus permitting the piston 226 to move in the first direction from the run-in-hole position to the actuated position. A pin, for example locking pin 237 may be positioned within the housing 202 of the tool assembly 200. The locking pin 237 may be biased, for example by a spring, in an inward direction towards to the piston 226. The locking pin 237 may be biased against the outer surface of the piston 226 when the piston 226 is in the run-in-hole position prior to the piston 226 being actuated by the additional pressure. The locking pin 237 may extend into the inner diameter $D_I$ of the housing in response to piston 226 moving in the first direction.

In some aspects, a tool assembly may be used to only pressure test a downhole tool (e.g., a sealing tool), for example the completion deflector assembly 220. In such aspects, the tool assembly may be configured as described above with respect to the tool assembly 200, though the locking pin 237 may not be biased and may instead be fixed in place (permanently or temporarily) to hold the piston 226 in the actuated position.

Figure 7:
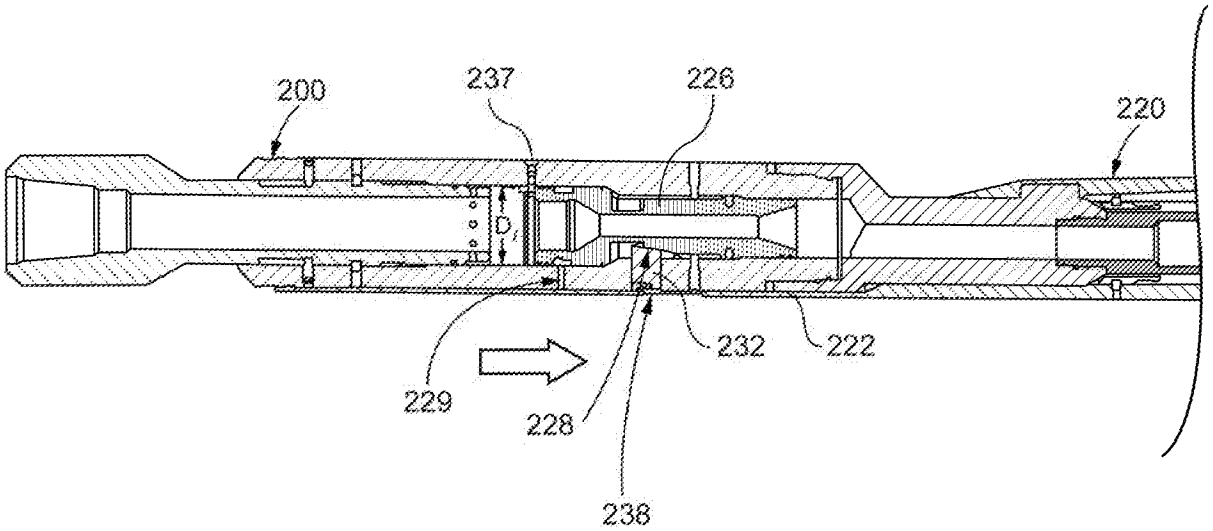
FIG. 7 is a partial cross-sectional view of the tool assembly uncoupled from the downhole tool, according to one aspect.

FIG. 7 depicts a partial cross-sectional side view of the tool assembly 200 and the completion deflector assembly 220 after the application of the additional pressure from the surface has forced or actuated the piston 226 in the first direction (shown by the arrow in FIG. 7). As shown in FIG. 7, the piston 226 has actuated in the first direction and the locking pin 237 has extended into the inner diameter $D_I$ of the housing to retain the piston 226 in place after actuation. The recess 228 may be angled, for example by angling the outer surface of the piston 226, as shown in FIG. 7. In some aspects, the depth of the recess 228 may increase along a length of the recess 228 to cause the recess 228 to be angled. In response to the movement of the piston 226 in the first direction, the projection 232 slides within the recess 228 along the outer surface of the piston 226. The movement of the projection 232 along the recess 228 moves the projection 232 inwardly, away from the housing 222 of the completion deflector assembly 220. Though only one projection 232 is visible in FIG. 7, additional projections 232 may be positioned within additional recesses 228 in the piston 226. For example, projections 232 may extend from three sides of the piston 226 (e.g., a left side, a right side, and a bottom side of the piston 226).

Figure 8:
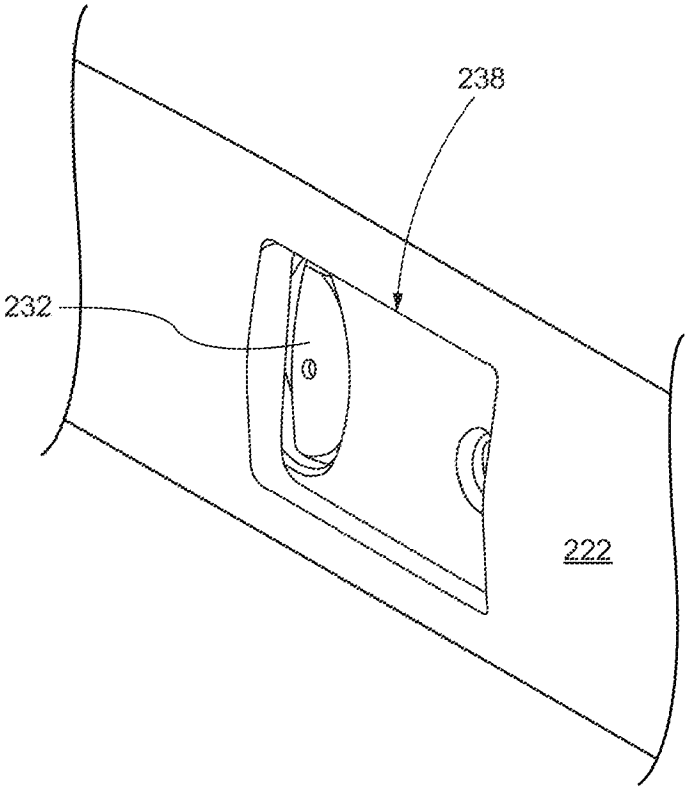
FIG. 8 is an enlarged perspective view of a portion of the tool assembly and the downhole tool in the position shown in FIG. 7, according to one aspect.

The movement of the projections 232 inwards away from the housing 222 of the completion deflector assembly 220, may position the projections 232 such that they no longer extend through the opening 238 in the housing 222 of the completion deflector assembly 220. FIG. 8 depicts an enlarged perspective view of a portion FIG. 7 including the projection 232 and the opening 238 in the housing 222 of the completion deflector assembly 220. As shown in FIGS. 7 and 8, following the actuation of the piston 226 the projection 232 has moved along the length of the recess 228 and no longer extends through the opening 238 in the housing 222. The tool assembly 200 is uncoupled from the completion deflector assembly 220 with the projection 232 no longer extending through the opening 238 in the completion deflector assembly 220, as shown in FIGS. 7 and 8. Uncoupled from the completion deflector assembly 220 the tool assembly 200 may be removed from the inner region of the completion deflector assembly 220 and returned to the surface.

In addition, the movement of the piston 226 in the first direction may also expose one or more ports, for example flow ports 229 in the housing 202. The flow ports 229 may have been blocked by the piston 226 when the piston 226 was in the run-in-hole position (shown in FIG. 5). Exposure of the flow ports 229 following the movement of the piston 226 in the first direction (shown by the arrow in FIG. 7) may cause the pressure in the tool assembly 200 to drop. The pressure drop may indicate to a user at the surface that the piston 226 has moved and thereby uncoupled the tool assembly 200 from the completion deflector assembly 220. The tool assembly 200 may be returned to the surface, leaving the completion deflector assembly 220 latched into the downhole receptacle.

In some aspects, the piston 226 can be forced in the first direction by a force other than the additional pressure from the surface. For example, if the application of the additional pressure from the surface fails to force the piston 226 in the first direction, a compressive force may be applied from the surface.

Figure 9:
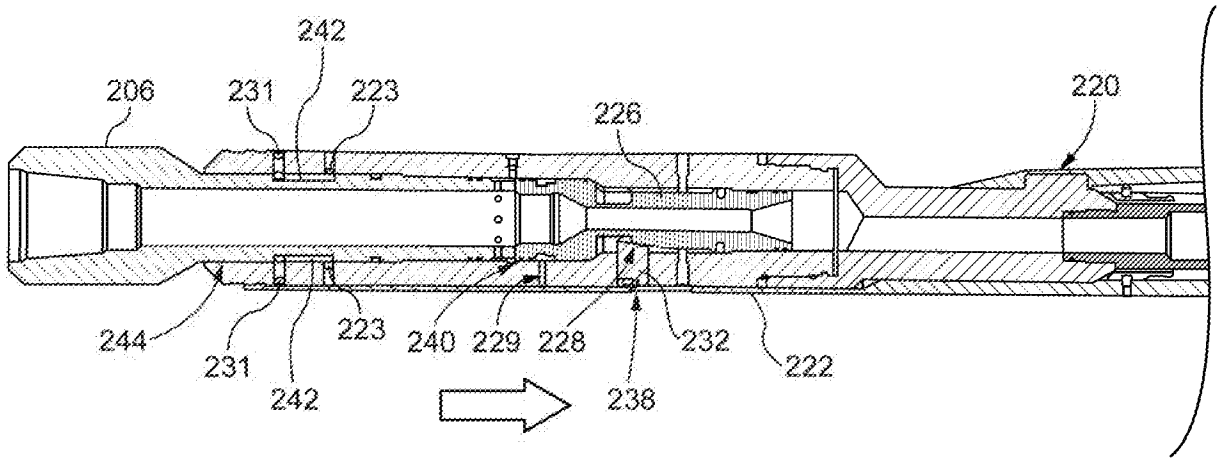
FIG. 9 is a partial cross-sectional view of the tool assembly uncoupled from the downhole tool, according to one aspect.

FIG. 9 depicts the tool assembly 200 and the completion deflector assembly 220 after a compressive force has been applied from the surface. The shifting sub housing 206 has been forced in the first direction (shown by the arrow in FIG. 9) by the compressive force. The force on the shifting sub housing 206 cause the shear pins 223 to shear permitting the shifting sub housing 206 to move in the first direction. The pins 231 may extend into a recess 242 in the shifting sub housing 206 that runs along a length of an outer surface 244 of the shifting sub housing 206. The pins 231 may couple the shifting sub housing 206 to the housing 202 in both the run-in-hole position (shown in FIG. 5) and in the actuated position following the application of compressive force (shown in FIG. 9).

The shifting sub housing 206 can move in the first direction once the shear pins 223 shear, and may contact the end 240 of the piston 226. The shifting sub housing 206 can thereby force the piston 226 in the first direction. The movement of the piston 226 in the first direction can move the projection 232 along the recess 228 in the outer surface of the piston 226. The projection 232 may move inwards away from the housing 222 of the completion deflector assembly 220 along the length of the recess 228. The movement of the projection 232 away from the housing 222 of the completion deflector assembly 220 may uncouple projection 232 from the opening 238 in the housing 222 of the completion deflector assembly 220 thereby decoupling the tool assembly 200 from the completion deflector assembly 220, as described with reference to FIG. 7 above.

Thus, in some aspects, the piston 226 can be forced in the first direction (shown by the arrow in FIG. 9) by the application of the additional pressure from the surface, or by the application of the compressive force from the surface. The movement of the piston 226 in the first direction may uncouple or disengage the projection 232 from the housing 222 of the completion deflector assembly 220. The tool assembly 200 is thereby uncoupled from the completion deflector assembly 220 and may return to the surface separate from the completion deflector assembly 200, which remains downhole latched into the downhole receptacle.

Example No. 1

A tool assembly that can be positioned within a wellbore may include a housing having an inner surface defining an inner diameter, a sub housing having a first projection for engaging a recess in a deflector tool, and a sealing element positionable within an inner region of the deflector tool for sealing the tool assembly to the deflector tool for pressure testing a seal between the deflector tool and a receptacle. The tool assembly may also include a piston positioned in the inner diameter of the housing. The piston may be moveable in a first direction between a run-in-hole position and an actuated position in response to an application of a pre-set amount of pressure from a surface of the wellbore. The tool assembly may also include at least one projection that is movable between a coupled position in which the at least one projection extends beyond an outer surface of the housing and a decoupled position in which the at least one projection does not extend beyond the outer surface of the housing. In the coupled position the at least one projection may couple with the deflector tool through an opening in the deflector tool.

Example No. 2

The tool assembly of Example No. 1 may also include an additional sub housing positioned within the inner diameter of the housing. The additional sub housing may be moveable between a first position and a second position in response to an application of a compressive force from the surface of the wellbore. The additional sub housing contacts an end of the piston when moving from the first position to the second position for forcing the piston in the first direction into the actuated position.

Example No. 3

The tool assembly of any of Example Nos. 1-2, may further include a pin extending through the inner surface of the housing, the pin being sized and positioned to be received in a recess in the piston. The pin may retain the piston in the run-in-hole position.

Example No. 4

The tool assembly of Example No. 3, may further include the pin being a shear pin. The shear pin may shear in response to the piston moving in the first direction from the run-in-hole position to the actuated position.

Example No. 5

Any of the tool assemblies of Examples No. 1-4 may further include a locking pin that extends through the inner surface of the housing. The locking pin may be biased towards the inner diameter of the housing. The locking pin may extend into the inner diameter of the housing in response to the piston moving in the first direction into the actuated position. The locking pin may retain the piston in the actuated position when it extends into the inner diameter of the housing.

Example No. 6

Any of the tool assemblies of Examples Nos. 1-4 may further include the pre-set amount of pressure being greater than a test amount of pressure applied from the surface to the tool assembly for pressure testing the seal between the deflector tool and the receptacle.

Example No. 7

Any of the tool assemblies of Examples Nos. 1-6, may further include the deflector tool being a completion deflector assembly.

Example No. 8

Any of the tool assemblies of Examples Nos. 1 wherein the at least one projection is positioned within a recess in an outer surface of the piston.

Example No. 9

A tool assembly may be positioned within a wellbore and may include a housing having an outer surface defining an outer diameter and an inner surface defining an inner diameter. The tool assembly may also include a sealing element coupled to the housing for sealing to a sealing surface of a sealing tool for pressure testing a seal between the sealing tool and a receptacle positioned downhole. A projection may extend from the inner diameter of the housing and may be moved between a coupled position and a uncoupled position. The projection may be moved between the coupled and uncoupled positions in response to an application of a pre-set amount of pressure from a surface of the wellbore. In the coupled position the projection may extend beyond the outer surface of the housing and couple to the sealing tool. In the uncoupled position, the projection may not extend beyond the outer surface of the housing.

Example No. 10

The tool assembly of Example No. 9 may also include a piston positioned in the inner diameter of the housing. The piston may move between a run-in-hole position and an actuated position in response to an application of a test pressure from the surface of the wellbore. The projection may be moved from the coupled position to the uncoupled position in response to the piston moving from the run-in-hole position to the actuated position.

Example No. 11

The tool assembly of Example No. 10 may also include the projection being positioned within a recess in an outer surface of the piston.

Example No. 12

The tool assembly of Example No. 11 may also include the diameter of the piston being varied along a length of the recess.

Example No. 13

The tool assembly of Example No. 10 may also include the piston being movable from the run-in-hole position to the actuated position in response to an application of compressive force from the surface of the wellbore.

Example No. 14

The tool assembly of Example No. 13 may also include a sub housing coupled to the housing. The sub housing may move between a first position and a second position in response to the application of compressive force from the surface. The sub housing may contact an end of the piston and may force the piston into the actuated position as the sub housing moves from the first position into the second position.

Example No. 15

Any of the tool assemblies of Example Nos. 9-14 may further comprise the sealing tool being a deflector tool.

Example No. 16

A method of deploying and pressure testing a sealing tool in a wellbore may include positioning a tool assembly coupled to a sealing tool within a wellbore. The sealing tool may be latched into a receptacle within the wellbore with the tool assembly coupled to the sealing tool. A first pressure may be applied to the tool assembly from a surface of the wellbore to test a seal between the sealing tool and the receptacle.

Example No. 17

The method of Example No. 16 may also include applying a second pressure to the tool assembly from the surface of the wellbore. The second pressure may be greater than the first pressure. The tool assembly may be decoupled from the sealing tool while the tool assembly is downhole in response to the application of the second pressure.

Example No. 18

The method of Example No. 17 may also include returning the tool assembly to a surface of the wellbore while the sealing tool remains latched into the receptacle in the wellbore.

Example No. 19

The method of Example No. 16, may also include returning the tool assembly and the sealing tool to a surface of the wellbore in response to the application of the first pressure indicating a seal is not established between the sealing tool and the receptacle. The tool assembly may be coupled to the sealing tool as the tool assembly and the sealing tool are returned to the surface.

Example No. 20

The method of Example No. 16 may further include applying a compressive force to the tool assembly from the surface of the wellbore. The tool assembly may be decoupled from the sealing tool while the tool assembly is within the wellbore in response to the application of the compressive force from the surface of the wellbore.

The foregoing description of certain aspects, including illustrated aspects, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A tool assembly positionable within a wellbore comprising:

a housing having an inner surface defining an inner diameter;

a sub housing having a first projection for engaging a recess in a deflector tool;

a sealing element positionable within an inner region of the deflector tool for sealing the tool assembly to the deflector tool for pressure testing a seal between the deflector tool and a receptacle;

a piston positioned in the inner diameter of the housing, the piston being moveable in a first direction between a run-in-hole position and an actuated position in response to an application of a pre-set amount of pressure from a surface of the wellbore, wherein the pre-set amount of pressure is greater than a test amount of pressure applied from the surface to the tool assembly for pressure testing the seal between the deflector tool and the receptacle; and a second projection that is movable between a coupled position in which the second projection extends beyond an outer surface of the housing for coupling with an opening in the deflector tool, and a decoupled position in which the second projection does not extend beyond the outer surface of the housing.

2. The tool assembly of claim 1, further comprising an additional sub housing positioned within the inner diameter of the housing, wherein the additional sub housing is moveable between a first position and a second position in response to an application of a compressive force from the surface of the wellbore, and wherein the additional sub housing contacts an end of the piston when moving from the first position to the second position for forcing the piston in the first direction into the actuated position.

3. The tool assembly of claim 1, further comprising a pin extending through the inner surface of the housing, the pin being sized and positioned to be received in a recess in the piston for retaining the piston in the run-in-hole position.

4. The tool assembly of claim 3, wherein the pin is shear pin for shearing in response to the piston moving in the first direction from the run-in-hole position to the actuated position.

5. The tool assembly of claim 1, further comprising a locking pin that extends through the inner surface of the housing and is biased towards the inner diameter of the housing, wherein the locking pin extends into the inner diameter of the housing in response to the piston moving in the first direction into the actuated position for retaining the piston in the actuated position.

6. The tool assembly of claim 1, wherein the deflector tool is a completion deflector assembly.

7. The tool assembly of claim 1, wherein the second projection is positioned within a recess in an outer surface of the piston.

8. A tool assembly positionable within a wellbore comprising:

a housing having an outer surface defining an outer diameter and an inner surface defining an inner diameter;

a sealing element coupled to the housing for sealing to a sealing surface of a sealing tool for pressure testing a seal between the sealing tool and a receptacle positioned downhole;

a projection extending from the inner diameter of the housing, the projection being movable between a coupled position and an uncoupled position in response to an application of a pre-set amount of pressure from a surface of the wellbore, wherein the projection extends beyond the outer surface of the housing for coupling to the sealing tool in the coupled position, and wherein the projection does not extend beyond the outer surface of the housing in the uncoupled position; and a piston positioned in the inner diameter of the housing, wherein the piston is moveable between a run-in-hole position and an actuated position in response to an application of a pre-set amount of pressure from the surface of the wellbore, wherein the pre-set amount of pressure is greater than a test amount of pressure applied from the surface to the tool assembly for pressure testing the seal between the sealing tool and the receptacle positioned downhole, and wherein the projection is moveable from the coupled position to the uncoupled position in response to the piston moving from the run-in-hole position to the actuated position.

9. The tool assembly of claim 8, wherein the projection is positioned within a recess in an outer surface of the piston.

10. The tool assembly of claim 9, wherein a diameter of the piston varies along a length of the recess.

11. The tool assembly of claim 8 wherein the piston is movable from the run-in-hole position to the actuated position in response to an application of compressive force from the surface of the wellbore.

12. The tool assembly of claim 11, further comprising a sub housing coupled to the housing, the sub housing being moveable between a first position and a second position in response to the application of compressive force from the surface, and wherein the sub housing contacts an end of the piston and forces the piston into the actuated position as the sub housing moves from the first position into the second position.

13. The tool assembly of claim 8, wherein the sealing tool is a deflector tool.

14. A method of deploying and pressure testing a sealing tool in a wellbore comprising:

positioning a tool assembly coupled to a sealing tool within a wellbore;

latching the sealing tool into a receptacle within the wellbore with the tool assembly coupled to the sealing tool;

applying a first pressure to the tool assembly from a surface of the wellbore to test a seal between the sealing tool and the receptacle; and returning the tool assembly and the sealing tool to a surface of the wellbore in response to the application of the first pressure indicating a seal is not established between the sealing tool and the receptacle, wherein the tool assembly is coupled to the sealing tool as the tool assembly and the sealing tool are returned to the surface.

15. The method of claim 14, further comprising:

applying a second pressure to the tool assembly from the surface of the wellbore, the second pressure being greater than the first pressure; and decoupling the tool assembly from the sealing tool while the tool assembly is downhole in response to applying the second pressure.

16. The method of claim 15, further comprising:

returning the tool assembly to a surface of the wellbore while the sealing tool remains latched into the receptacle in the wellbore.

17. The method of claim 14, further comprising:

applying a compressive force to the tool assembly from the surface of the wellbore; and decoupling the tool assembly from the sealing tool while the tool assembly is within the wellbore in response to the application of the compressive force from the surface of the wellbore.

18. The method of claim 14, wherein the step of positioning a tool assembly coupled to a sealing tool within a wellbore further comprises:

positioning the tool assembly, wherein the tool assembly comprises:

a housing having an inner surface defining an inner diameter;

a sub housing having a mating feature for engaging with the receptacle within the wellbore; and a piston positioned within the inner diameter of the housing, the piston being moveable in a first direction between a run-in-hole position and an actuated position in response to an application of a second pressure from a surface of the wellbore, wherein the second pressure is greater than the first pressure.

19. The method of claim 18, further comprising:

applying second pressure to the tool assembly from the surface of the wellbore;

forcing the piston from the run-in-hole position to the actuated position in response to the application of the second pressure, wherein in the actuated position the tool assembly is decoupled from the sealing tool.

20. The method of claim 19, further comprising:

moving a projection on the piston from a coupled position to a decoupled position in response to the piston moving from the run-in-hole position to the actuated position, wherein in the coupled position the projection extends beyond an outer surface of the housing, and wherein in the decoupled position the projection does not extend beyond the outer surface of the housing.

* * * * *